United States Patent [19]

Weinzierl

[11] 4,289,180

[45] Sep. 15, 1981

[54] BANDSAW MILL

[76] Inventor: Frank Weinzierl, 2667 E. 57th Ave., Vancouver, British Columbia, Canada, V5S 2A9

[21] Appl. No.: 75,348

[22] Filed: Sep. 13, 1979

[30] Foreign Application Priority Data

Oct. 27, 1979 [CA] Canada ..... 314525

[51] Int. Cl.[3] ..... B27B 13/00; B27B 29/00

[52] U.S. Cl. ..... 144/312; 83/794; 144/326 R; 198/344; 198/414; 269/152; 414/433

[58] Field of Search ..... 144/312, 326 R; 83/522, 83/574, 745, 788, 794, 797, 802, 801; 269/152, 164; 198/344, 414; 414/433, 757

[56] References Cited

U.S. PATENT DOCUMENTS

| | | | |
|---|---|---|---|
| 1,238,436 | 8/1917 | Reece | 83/801 |
| 3,243,987 | 4/1966 | Saylor | 414/757 X |
| 3,285,301 | 11/1966 | McManama | 83/801 |
| 3,604,481 | 9/1971 | Dobbs | 83/788 |
| 3,954,037 | 5/1976 | Rios | 83/788 X |
| 4,029,196 | 6/1977 | Ekholm | 414/433 |
| 4,106,632 | 8/1978 | Bossi | 414/433 |
| 4,179,961 | 12/1979 | Harris | 83/801 |

FOREIGN PATENT DOCUMENTS

| | | | |
|---|---|---|---|
| 2731627 | 11/1978 | Fed. Rep. of Germany | 83/874 |

*Primary Examiner*—W. D. Bray

*Attorney, Agent, or Firm*—Townsend and Townsend

[57] ABSTRACT

A bandsaw mill comprises two vertical bandwheels for receiving and guiding a bandsaw. The bandwheels are mounted on a frame for rotation about horizontally spaced-apart axes. A bridge suspends the frame above the position of a log with the axes of the bandwheels being generally parallel to the longitudinal axis of the log. The log is between the bandwheels. The bandsaw mill includes a mechanism for raising and lowering the frame, a mechanism for moving the bridge longitudinally along the position of the log and clamps for securing the log in a generally horizontal position. A method of sawing the log comprises moving the log into a generally horizontal position, securing the log in the position and moving the horizontally oriented bandsaw in a longitudinal direction along the log to make horizontal cuts along the log.

12 Claims, 9 Drawing Figures

BANDSAW MILL

BACKGROUND OF THE INVENTION

The invention relates to a bandsaw mill and a method of sawing a log.

The most valuable timber in large cedars is found in the bottom log. This log is hollow but is clear wood, containing no knots. One method of sawing such cedar logs into timber consisting of cutting the hollow log into a number of segments by making a plurality of longitudinally extending radial cuts. Each of these segments has a laterally convex bottom, comprising the outside of the log, and two flat sides along the radial cuts converging towards a laterally concave top, which is the inside of the log. Each segment is then cut to produce flat, parallel top and bottom surfaces and the excess cedar is discarded. A series of parallel cuts, perpendicular to the top and bottom surfaces, are then made to produce a plurality of boards from each segment. This method of cutting the log reduces a high proportion of the valuable cedar into waste.

SUMMARY OF THE INVENTION

According to this invention, a bandsaw mill has means for securing a log to be sawn in a generally horizontal position. The mill has a bandwheel mounting frame and two vertical bandwheels for receiving and guiding a bandsaw. The bandwheels are mounted on the frame for rotation about horizontally spaced-apart axes. A bridge is provided for suspending the frame above the position of the log with the axes of the bandwheels generally parallel to a longitudinal axis of the log. The position of the log is between the bandwheels. A mechanism is provided for raising and lowering the frame. Means is provided for moving the bridge longitudinally along the position of the log.

According to another aspect of the invention, a method of sawing a log comprises moving the log into a generally horizontal position; securing the log in the position; and moving a horizontally oriented bandsaw guided by vertical bandwheels in a longitudinal direction along the log to make a horizontal cut along the log.

Where the log is a bottom cedar log with a hollow extending longitudinally along the center of the log, the method comprises cutting the log to form two thick sections, one thick section extending upwardly from the hollow and another thick section extending downwardly from the hollow.

The bandsaw mill and method of sawing according to the invention produce highly marketable age grain cedar boards when used for cutting hollow cedar logs. These boards look better, are more resistant to bending and sell for a better price than the non-age grain boards produced on other mills and by other cutting methods. Additionally, a very high proportion of the wood in each cedar log is converted into marketable boards and the yield is appreciably higher than found with earlier cutting methods as mentioned above.

When compared with similarly oriented stationary bandsaw mills, bandsaws mills according to the invention allow for a much easier handling of the timber. The heavy timber can remain stationary, since the saw itself is capable of movement along the timber.

BRIEF DESCRIPTION OF THE DRAWINGS

In drawings which illustrate embodiments of the invention.

DESCRIPTION OF THE PREFERRED EMBODIMENTS

Figure 6:
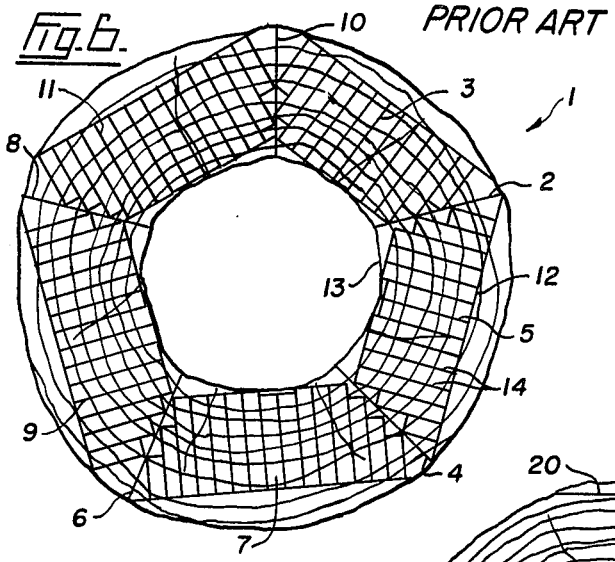
Fig. 6. PRIOR ART
FIG. 6 shows a hollow cedar log as sawn according to prior art.

The bottom hollow logs of large cedars, containing the most valuable and knot-free wood, has traditionally been milled as shown in FIG. 6. The log 1 is first cut into a plurality of segments 3, 5, 7, 9 and 11 by radially extending longitudinal cuts 2, 4, 6, 8 and 10. Referring to segment 5, each segment is then cut to provide flat bottom and top surfaces 12 and 13 respectively. A successive number of cuts 14, perpendicular to the top and bottom surfaces, are then made to produce a plurality of boards. Considering the wood wasted in producing the flat bottom 12, the flat top 13 and in edging the boards, a relatively high proportion of this valuable wood is wasted.

Figure 7:
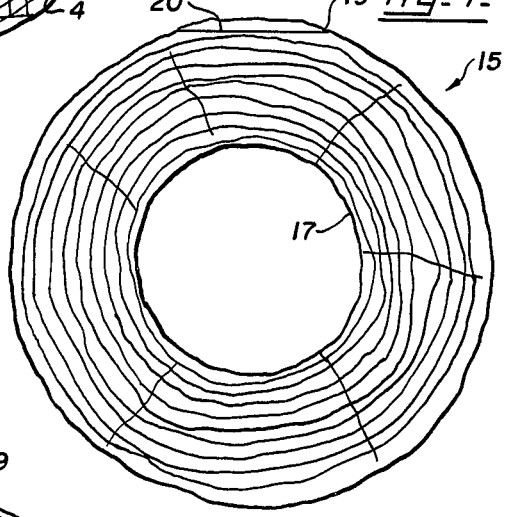
FIG. 7 is a sectional view of a hollow cedar log showing the first cut on the log using a method of sawing according to the invention.
Figure 8:
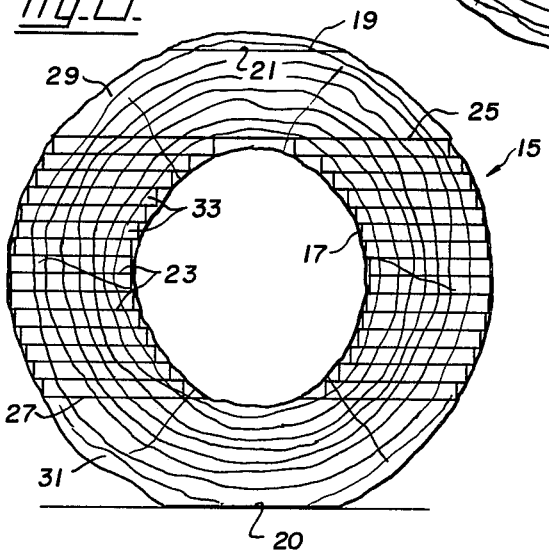
FIG. 8 shows the log of FIG. 7 rotated 180° and with a successive number of horizontal cuts to form thick sections above and below the hollow center with the portion of the log between the thick sections being cut into a plurality of flat boards.
Figure 9:
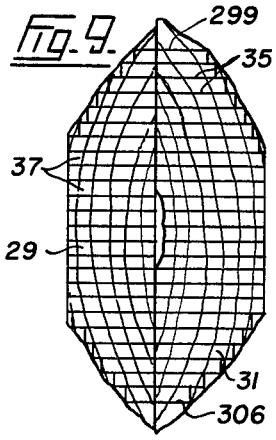
FIG. 9 shows the two thick section of FIG. 8 cut into a plurality of flat boards after being rotated 90° and clamped together.

By comparison, FIGS. 7 to 9 illustrate a method of sawing a hollow cedar log according to the invention. The method according to the invention requires a saw capable of making a successive number of horizontal cuts in the log. Referring to FIG. 7, the cedar log 15 with a hollow center 17 is secured in the horizontal position by clamping means as described below. The first horizontal cut 19 is made along the top of the log 15 to provide a flat surface 20. The log 15 is then rotated 180° to the position shown in FIG. 8 with surface 20 providing a flat bottom to stabilize the log. The second cut 19 is then made to produce a flat surface 21 parallel to surface 20 on the opposite side of the log. A successive number of horizontal cuts 23 are then made along the log beginning with cut 25 near the top of hollow 17 and ending with cut 27 near the bottom of hollow 17. This produces two thick sections 29 and 31, the former extending upwardly from the hollow 17 and the latter extending downwardly from the hollow 17. After suitable edging, the portion of the log between sections 29 and 31 produces a plurality of flat boards 33. After the boards 33 are removed, sections 29 and 31 are brought together and turned through 90° to the position shown in FIG. 9. After being secured in this position, a successive number of parallel cuts 35 are made along sections 29 and 31 to form a plurality of flat boards 37 which are then sent to a suitable bandsaw or the like for edging. By comparing FIG. 6 with FIGS. 7 to 9, it may be seen that the method of sawing according to the invention considerably reduces the amount of wasted wood. Additionally, all of the boards produced by this method are age grain cuts.

FIGS. 1 to 5 show a bandsaw mill especially suitable for milling hollow cedar logs according to the method illustrated in FIGS. 7 to 9. The bandsaw mill 40 has a pair of parallel vertical frames 42 and 44. Frames 42 and 44 have corresponding horizontal members 46 and 48, preferably steel I-beams, secured on the tops of a plurality of columns 50 by suitable means such as welding. The columns 50 are preferably secured in position by suitable concrete footings. Rails 52 and 54 extend longitudinally along the tops of members 46 and 48 and suitable stops 56 are provided at both ends of both rails. Rails 52 and 54 are circular bars welded to the top of members 46 and 48.

A carriage 58 is provided for traversing the bandsaw mill parallel to members 46 and 48. Carriage 58 comprises a bridge 60 for laterally spanning the distance between members 46 and 48. Carriage 58 is provided with four flanged wheels 62, 64, 66 and 68. Wheels 62 and 66 rest on rail 52 and wheels 64 and 68 rest on rail 54. Wheels 62 and 64 are secured to axle 70 which extends between rails 52 and 54 and wheels 56 and 58 are fixedly secured to axle 72 which extends between rails 54 and 52 also. Axles 70 and 72 are rotatably mounted on bridge 60 by suitable bearings.

An electric motor 74 with a V-sheave 76 is mounted on bridge 60 adjacent wheel 64. A V-belt 80 connects sheave 76 to a corresponding sheave 78 fixedly mounted on axle 70 adjacent wheel 64. Motor 74, sheaves 76 and 78 and V-belt 80 provide propulsion means for moving carriage 58 along rails 52 and 54.

Bridge 60 comprises a perimeter frame 82, preferably of structural steel channels or I-beams. Cross members 84 and 86 are box-shaped, fabricated from steel plate and provide rigidity to bridge 60. A pair of opposing vertically extending slots 88 and 90 are provided in members 84 and 86 for a purpose to be described below. A second pair of cross members 92 and 94 extend across perimeter frame 82 inwardly from and parallel to members 84 and 86. Members 92 and 94 provide support for fluid cylinders 96 and 98 respectively.

A bandwheel mounting frame 100 is connected to the distal ends of rods 102 and 104 of cylinders 96 and 98 respectively. Frame 100 comprises a box-shaped steel section. Uprights 126 and 128 extend upwardly from the top of frame 100 and are connected thereto by welding other suitable means. Uprights 126 and 128 have outwardly directed flanges 130 and 132 respectively which extend downwardly over the ends of frame 100. Flanges 130 and 132 are slidably received within the slots 88 and 90 of members 84 and 86 to provide guide means for the upward and downward movement of frame 100. Cylinders 96 and 98 provide means for raising or lowering frame 100.

Vertical bandwheels 106 and 108 are rotatably mounted on frame 100 about horizontally spaced-apart axes 114 and 116 respectively by means of axles 110 and 112 and suitable bearings. An electric motor 118 is mounted on the top of frame 100 and has a V-pulley 120. A second V-pulley 122 is mounted on shaft 112 adjacent bandwheel 108 and a V-belt 124 operatively connects pulleys 120 and 122. A double-edged bandsaw 134 with a lower horizontally extending cutting portion 136 is mounted for rotation about bandwheels 106 and 108. Guides 138 and 140 for bandsaw 134 are connected to the bottom of frame 100.

A squared shaft 142 extends along the inside of member 48 and is rotatably mounted on bearings. A console 146 with a clock 148 is mounted at one end of frame 44 below member 48. A sprocket 150 is operatively connected to clock 148 to rotate the dials of the clock. A continuous chain 152 connects sprocket 150 to another sprocket 154 connected to the end of square shaft 142. Accordingly, clock 148 registers the rotation of shaft 142.

Figure 1:
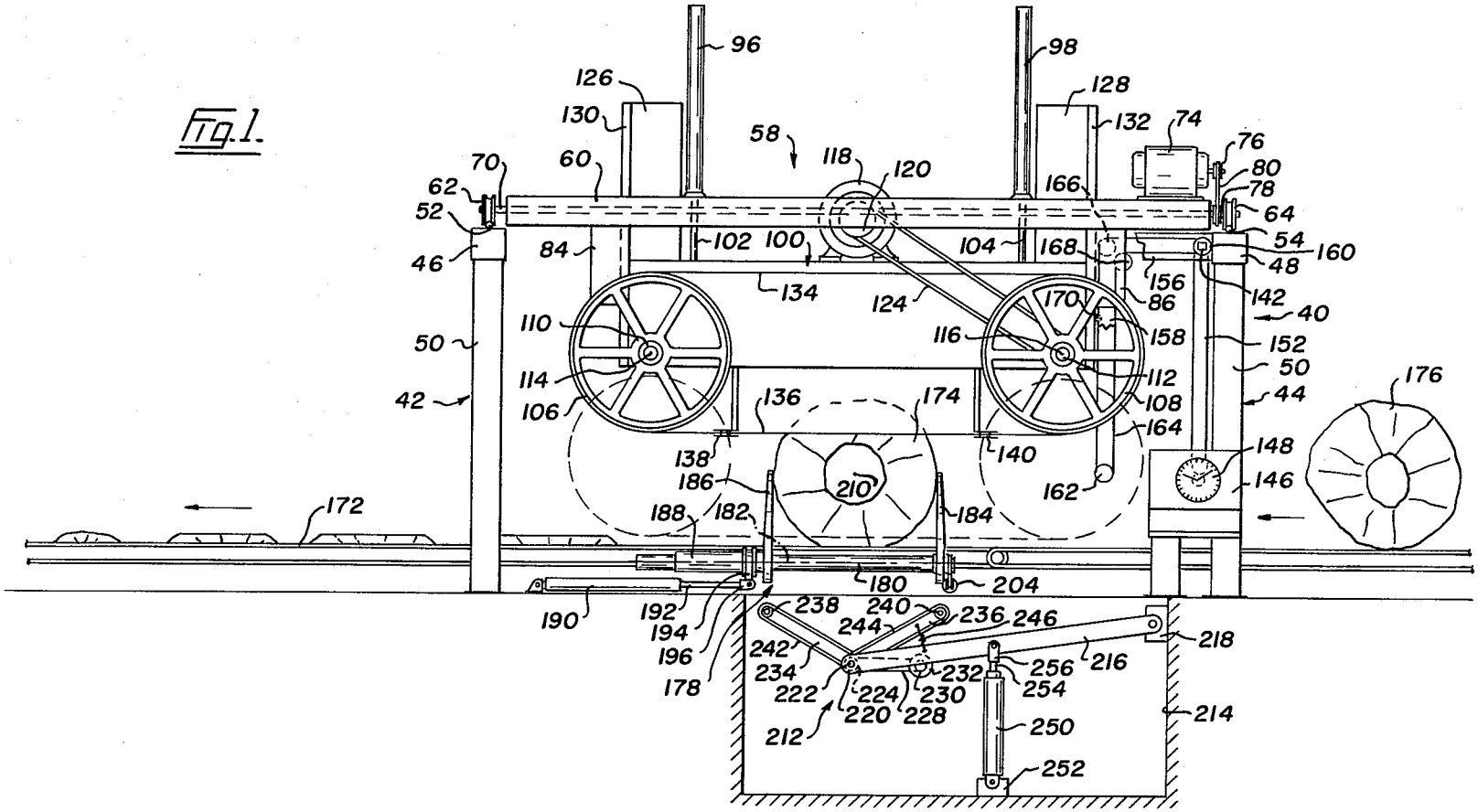
FIG. 1 is an end elevational view of a bandsaw mill according to an embodiment of the invention.

As seen in FIG. 1, member 86 has a lateral extension 156 and a downward extension 158. A sprocket 160 is rotatably connected to the end of lateral extension 156 and has a square central aperture for slidably fitting on square shaft 142. Consequently, sprocket 160 rotates square shaft 142 and is capable of sliding along shaft 142. A chain 164 has a horizontal portion extending from sprocket 160 to sprockets 166 and 168 on member 86 and a vertical section from these sprockets to sprocket 162 at the bottom of extension 158. Chain 164 is fixedly connected to eyelet 170 on flange 132 of upright 128.

Bandsaw mill 40 includes a chain conveyor 172 for moving logs, such as logs 174 and 176, into a horizontal position parallel to and midway between frames 42 and 44. Conveyor 172 is a standard chain conveyor well known in the industry and will not be described in detail. Conveyor 172 extends perpendicular to frames 42 and 44 at the bottoms thereof.

A log to be sawn is moved into the position of log 174 shown in the drawings, by means of chain conveyor 172. Means for securing this log in the generally horizontal position is provided by clamp mechanism 178. Clamp mechanism 178 comprises a plurality of parallel, spaced-apart shafts 180, each rotatable about a clamp axis 182. Each of the shafts 180 has a pair of spaced-apart clamp members 184 and 186. Each of the clamp members 184 is fixedly connected to its shaft 180 for rotation about the respective clamp axis 182. Each of the clamp members 186 is fixedly connected to a sleeve 188 which is slidable along shaft 180 and rotatable therewith by means of a keyway. Means for moving corresponding clamp members 186 and 184 towards each other and away from each other along the clamp axis 182 comprises a cylinder 190 with a piston rod 192 connected to sleeve 188 by means of bracket 194 and clevis 196. A continuous drive chain 198 is fitted about the sprockets 200 connected to the ends of each of the shafts 180 closest to frame 44. Rod 202 of fluid cylinder 204 is connected to chain 198 by means of bracket 206 and clevis 208.

If desired, chain 198 and sprocket 200 can be replaced by a system of cranks and levers to rotate clamp members 184.

The bandsaw mill 40 is also equipped with means for turning the log 174 about its longitudinal axis 210. The means for turning the log consists of a plurality of log turners 212 spaced apart along the length of the log 174. Referring to FIG. 1, each log turner 212 is located within a pit 214 below the chain conveyor 172. An arm 216 of each log turner is pivotally connected to a bracket 218 which is fixedly mounted on the wall of pit 214. Arm 216 extends to a distal end 220 below the center of log 174. A shaft 222 is rotatably connected to distal end 220 of arm 216. A triple chain sprocket 224 is connected to shaft 222. A chain 228 connects sprocket 224 to sprocket 230 of electric motor 232 mounted on arm 216. A pair of guide bars 234 and 236 are rotatable about shaft 222 and are fixedly connected to each other adjacent shaft 222. Bars 234 and 236 are connected together to form an upwardly opening obtuse angle and sprockets 238 and 240 are rotatably mounted to the distal ends of bars 234 and 236 respectively. Bar 234 and sprocket 238 acts as a guide, similar to the guide bar of a chain saw, for a continuous chain 242 connecting sprocket 238 and sprocket 224. Similarly, bar 236 and sprocket 240 provides guides for chain 244. A spring 246 connects bar 236 to arm 216 to maintain bars 234 and 236 generally in the position shown. A cylinder 250 is pivotally mounted on bracket 252 at the bottom of pit 214 and extends upwardly therefrom. The rod 254 of cylinder 250 is pivotally connected to arm 216 by means of clevis 256.

In operation, the cutting portion 136 of bandsaw 134 is first raised above the position of the log 174. This is accomplished by raising frame 100 by means of hydraulic cylinders 96 and 98. Flanges 130 and 132 of uprights 126 and 128, together with slots 88 and 90 in members 84 and 86, act as guides for the upward and downward movement of frame 100. Carriage 58 is then moved to the position shown in FIG. 2 along rails 52 and 54 by means of electric motor 74 connected to axle 70 by V-belt 80. The next log to be sawed, for example log 176 shown in FIG. 1, is then moved into the position of log 174 by means of chain conveyor 172. When the log to be cut is so positioned, chain conveyor 172 stops and this lowers the log onto skids 260.

With motor 118 operating, frame 100 is lowered by cylinders 96 and 98 so the cutting portion 136 of the bandsaw 134 is in position to make the first cut 19 along the log 174 as shown in FIG. 7 for log 15. The carriage 58 is the moved along rails 52 and 54 by means of motor 74 to the opposite end of log 174 to complete the first cut.

Before the second cut, as described above, the log 174 must be turned about its longitudinal axis 210 through an angle of 180°. This is accomplished by the operation of the cylinders 250 acting as means for raising and lowering each of the arms 216, bringing chains 242 and 244 into contact with the log 174. With cylinders 250 having sufficient upward force to slightly raise the log 174, motors 232 are operated to turn chains 242 and 244 which rotate log 174 which fits within the upwardly opening V shape of chains 242 and 244. After the log is rotated through 180°, the motors 232 are stopped and cylinders 250 lowered until the flat surface 20, as seen in FIG. 8, rests upon skids 260.

Figure 2:
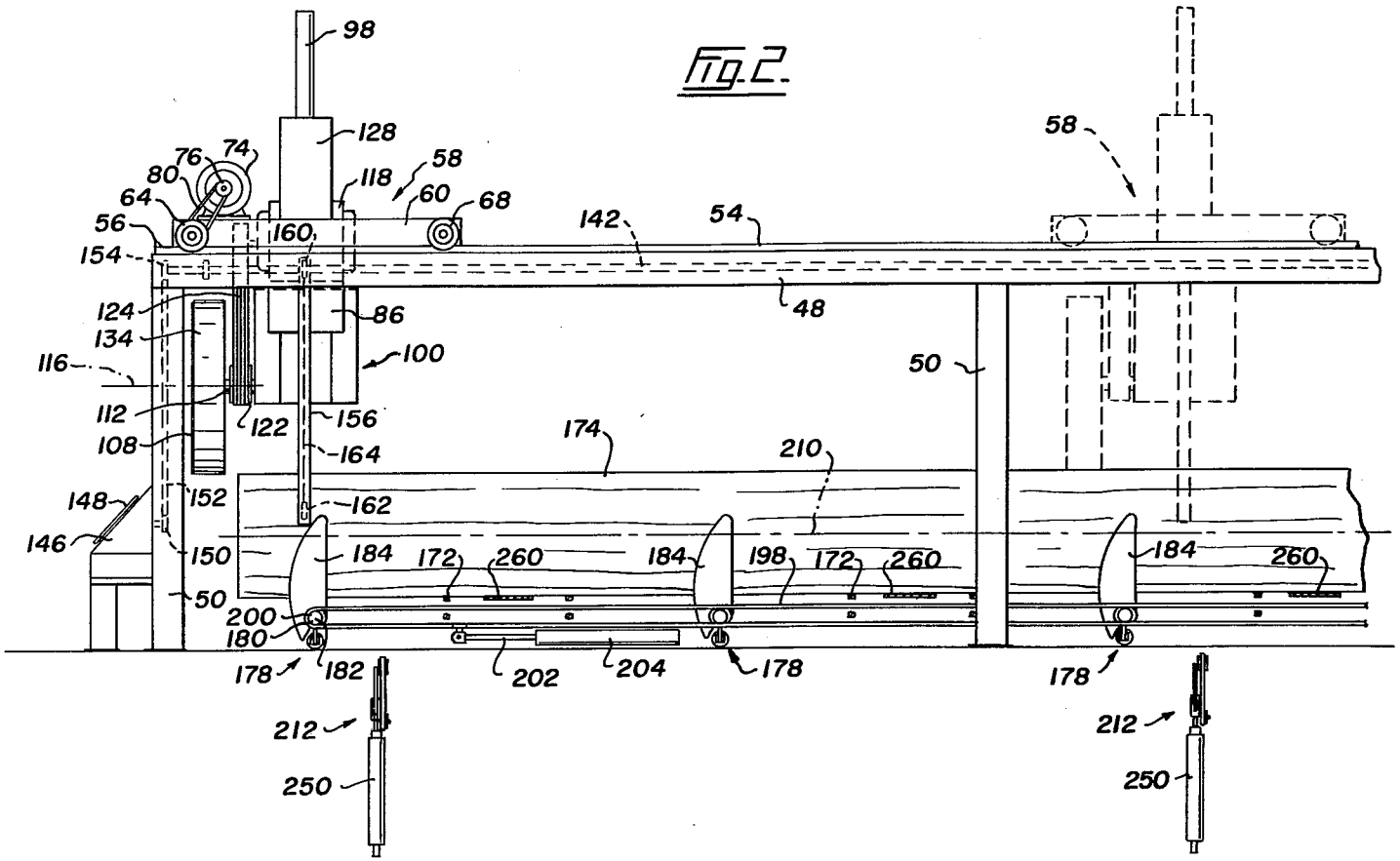
FIG. 2 is a side elevational view of a portion of bandsaw mill shown in FIG. 1.
Figure 3:
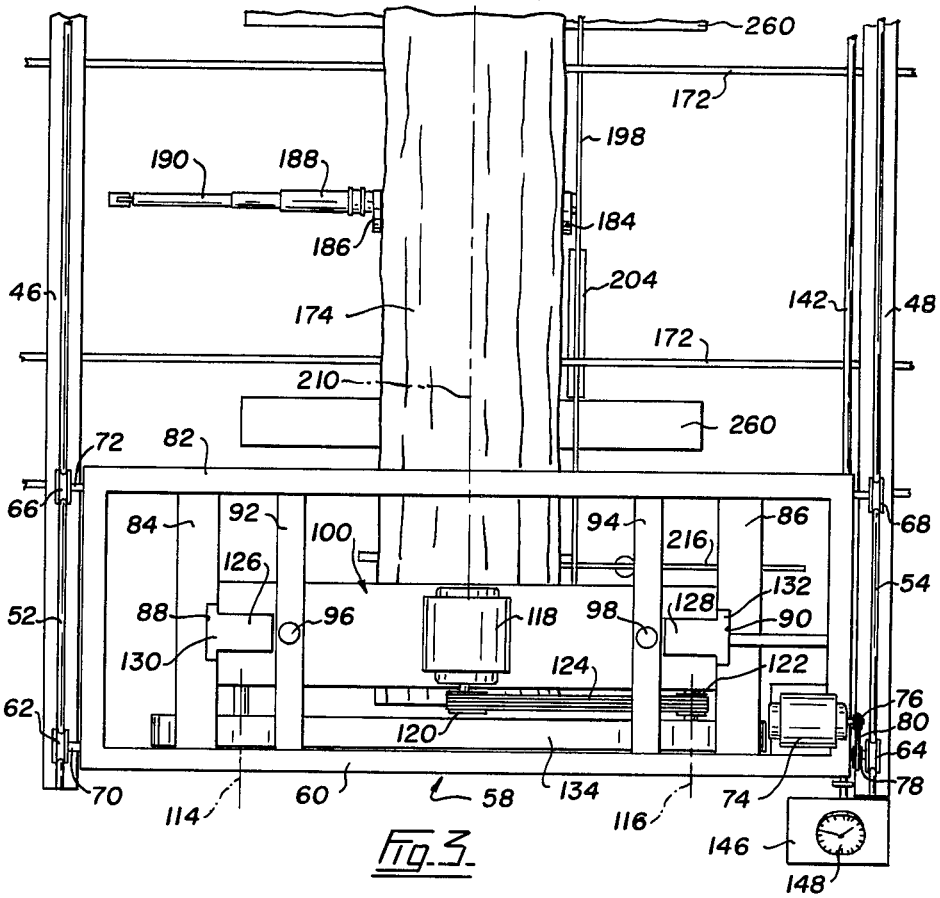
FIG. 3 is a top plan view of a portion of the bandsaw mill shown in FIG. 1.

Log 174 is secured in position by raising clamp members 184 and 186 to the position shown in FIG. 1 and clamping log 174 by moving clamp members 186 towards members 184 through the operation of cylinders 190. Saw 134 then makes the second cut 21, as shown in FIG. 8, by moving the carriage 58 along rails 52 and 54 back to the end of frames 42 and 44 as seen in FIG. 2.

The next cut made to log 174 is the cut 25 shown in FIG. 8. This is accomplished by first lowering cutting portion 136 of saw 134 to the position shown in FIG. 1.

The position of cutting portion 136 is indicated at all times by clock 148. As frame 100 moves upwardly or downwardly, eyelet 170 rotates sprocket 160 by means of chain 164 as guided by sprockets 162, 166 and 168. As mentioned above, sprocket 160 is slidable along square shaft 142 and rotates shaft 142 regardless of the position of frame 100 along frames 42 and 44. The rotation of shaft 142 rotates sprocket 154 which is connected to sprocket 150 of clock 148 by chain 152. Consequently, the hands of clock 148 are rotated during the upward and downward movement of frame 100 and can easily be calibrated to indicate the vertical position of cutting portion 136 of the saw 134. With one needle of clock 148 not operatively connected to sprocket 150, this needle can be set at the desired vertical position of the cutting portion 136 of saw 134. The mill operator then simply adjusts the height of frame 100 until the needle connected to sprocket 150 coincides with the stationary needle.

After cutting portion 136 is properly positioned to make the cut 25, bridge 58 is moved along log 174 to complete the cut. The thick section 29, as shown in FIG. 8, can then be removed by manual means using grapple hooks or the like. A plurality of cuts 23, as shown in FIG. 8, are then made along the log by moving carriage 58 along rails 52 and 54 and adjusting the vertical position of cutting portion 136 to give the desired thickness of cut as indicated by clock 148. The boards 133 cut from the log can be removed manually after each cut.

Figure 4:
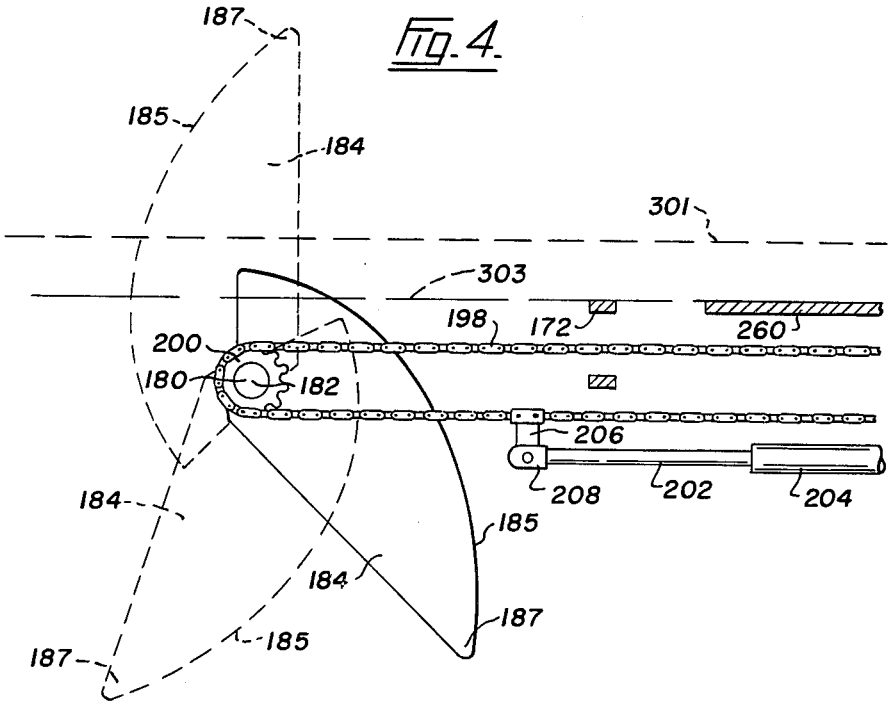
FIG. 4 is an end elevational view of one clamp mechanism for holding a log in place in the bandsaw mill of FIG. 1.
Figure 5:
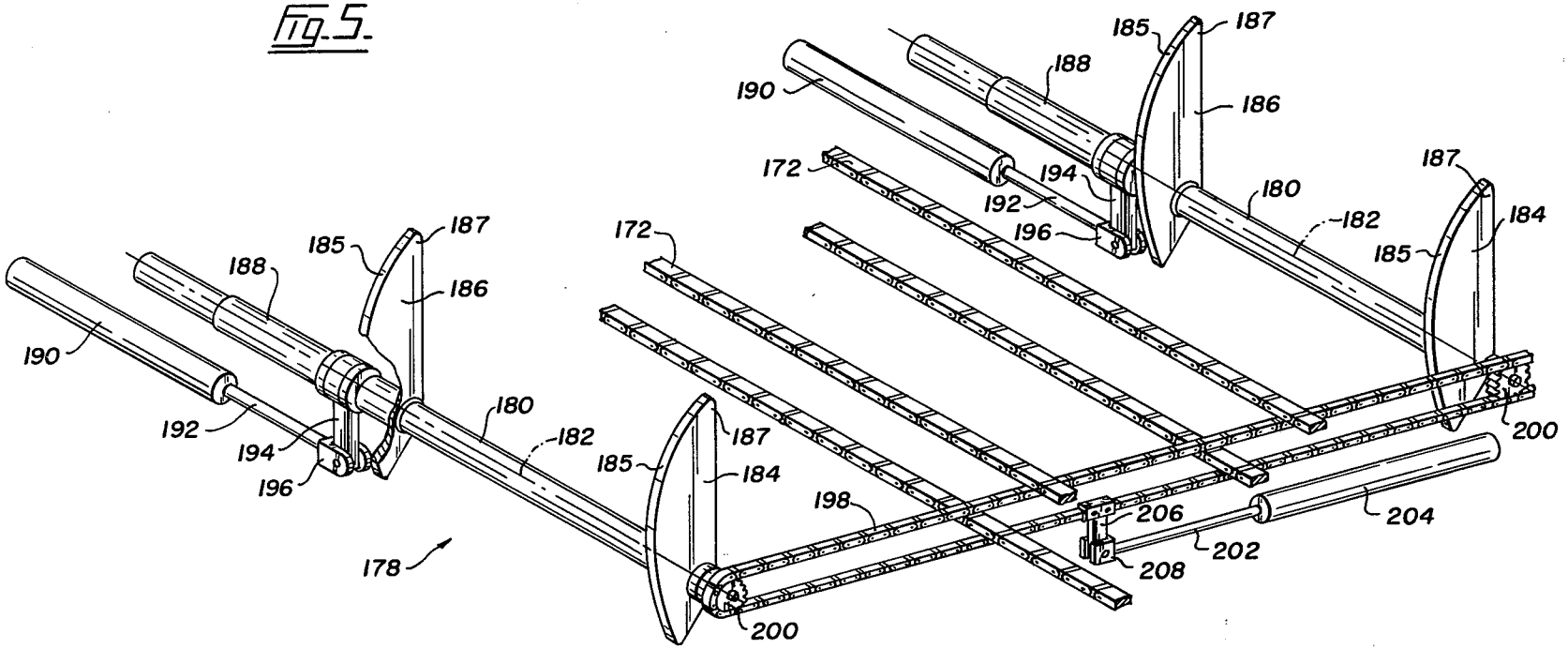
FIG. 5 is an isometric view of two adjacent clamp mechanisms, the fluid cylinder for rotating the mechanisms and the drive chain connecting the two adjacent mechanisms.

Once the level of cutting portion 136 reaches the tops of clamp members 184 and 186, it is necessary to lower the clamp members by rotating them about shafts 180 by means of cylinder 204 and chain 198. Referring to FIG. 4, the clamp member 184 is shown in broken lines in the fully raised and fully lowered positions. The log is secured with the clamp members 184 and 186 in the fully raised position until the saw approaches the tip 187 of the clamp members. At this point, the clamp members 184 and 186 are turned downwardly in the clockwise direction, from the point of view of FIG. 4, in incremental amounts with each pass of the saw along the logs. In FIG. 4, broken line 301 represents the lowest cut of the saw and broken line 303 represents the bottom of the log when resting on skids 260. The position of clamps 184 and 186, as shown in solid lines for the clamp member 184 of FIG. 4, is the position of the clamp members for holding the log during the last cut of the saw. Since the log tapers towards the bottom, it is necessary to bring clamp members 184 and 186 closer together as the clamp members are downwardly rotated. This is accomplished by moving clamp member 186 towards clamp members 184 with cylinders 190.

The last cut of the saw, with the logs held in the position of FIG. 8, is cut 27. After this cut is made, the thick portion 29 and 31 are brought together and rotated through 90° to the position shown in FIG. 9. Clamp members 184 and 186 are brought together to hold the two thick sections together in the position of FIG. 9. The saw 134 is again used to make a successive number of horizontal cuts 35 along the two sections to provide a plurality of boards 37. The last cut is cut 306 shown in FIG. 9 and this corresponds to the lowest cut 301 of the saw shown in FIG. 4.

What is claimed is:

1. A bandsaw mill comprising:

means for securing a log to be sawn in a generally horizontal position, said means for securing including a pair of spaced-apart clamp members extending from a clamp axis beneath the position of the log and perpendicular to the log axis, the clamp members being simultaneously rotatable about the clamp axis between a generally vertical position for securing the log and a lowered position for moving the log to a position between the clamp members, the clamp members being movable towards each other along the clamp axis for securing the log between the clamp members;

a bandwheel mounting frame;

two vertical bandwheels for receiving and guiding a bandsaw, the bandwheels being mounted on the frame for rotation about horizontally spaced-apart axes;

a bridge for suspending the frame above the position of the log with the axes of the bandwheels being generally parallel to a longitudinal axis of the log, the position of the log being between the bandwheels;

a mechanism for raising and lowering the frame; and means for moving the bridge longitudinally along the position of the log.

2. A bandsaw mill as claimed in claim 1, the means for moving the bridge including rails parallel to the bandwheel axes, the frame being located between the rails, wheels rotatably connected to the bridge for mounting the bridge on the rails, and a motor coupled to at least one wheel for moving the bridge along the rails.

3. A bandsaw mill as claimed in claim 1 or claim 2, the mechanism for raising and lowering the frame comprising at least one fluid cylinder connected to the bridge and to the frame.

4. A bandsaw mill as claimed in claim 2, comprising a pair of spaced-apart, vertical frames, the position of the log extending between the vertical frames and parallel to the vertical frames, the rails being mounted along the vertical frames.

5. A bandsaw mill as claimed in claim 1, the clamp members each having a corresponding edge defining a curve extending away from the clamp axis, so that the extent of the clamp members above the clamp axis varies as the clamp members rotate about the clamp axis.

6. A bandsaw mill as claimed in claim 1 or claim 6 comprising at least two said means for securing, the means for securing being spaced-apart along the position of the log.

7. A bandsaw mill as claimed in claim 1, comprising means for turning the log about a longitudinal axis of the log.

8. A bandsaw mill as claimed in claim 7, the means for turning comprising two continuous chains mounted on rotatable sprockets below the position of the log, the chains extending outwardly and upwardly generally in the shape of an upwardly opening V, and means for raising and lowering the chains. lowering the chains.

9. A bandsaw mill as claimed in claim 8, the means for raising and lowering comprising a lever with a pivot point near one end, the chains being mounted near an end of the lever distal the one end, and a fluid cylinder connected to the lever for raising the means for turning towards the position of the log and for lowering the means for turning away from the position of the log.

10. A bandsaw mill as claimed in claim 9, comprising at least two said means for turning, each said means for turning being spaced-apart along the position of the log.

11. A bandsaw mill as claimed in claim 1 or claim 2, comprising a chain conveyor extending parallel to the bandsaw and below the position of the log for moving logs into the position.

12. A method of sawing a bottom cedar log with a hollow extending longitudinally along the center of the log, said method comprising the steps of:

moving the log into a generally horizontal position;

securing the log in the position;

moving a horizontally oriented bandsaw guided by vertical bandwheels in a longitudinal direction along the log to make a first horizontal cut along the log;

rotating the log 180° so that the log rests on a surface exposed by the first horizontal cut;

moving the bandsaw from one end of the log toward another end of the log a plurality of times to make a number of successive, horizontal cuts, the bandsaw being initially lowered to a level substantially equal to that of the top of the hollow and thereafter lowered after each of said cuts to determine the thickness of the cuts until the bandsaw reaches a level substantially equal to that of the bottom of the bottom of the hollow, whereby two thick sections of the log remain, the first thick section including that portion of the log extending upward from the hollow and the second thick section including that portion of the log extending downward from the hollow;

removing the boards formed by the successive cuts in the portion of the log between the two thick sections;

turning the thick portions through 90°;

securing the thick portions together in the position of the log; and sawing the thick portions with the bandsaw in a succession of horizontal cuts.

* * * * *